US010439305B2

(12) United States Patent
Stjepanovic et al.

(10) Patent No.: US 10,439,305 B2
(45) Date of Patent: Oct. 8, 2019

(54) CONNECTION APPARATUS FOR CONDUCTORS

(71) Applicant: Weidmüller Interface GmbH & Co. KG, Detmold (DE)

(72) Inventors: Karlo Stjepanovic, Bielefeld (DE); Stephan Fehling, Lage (DE); Walter Hanning, Detmold (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days.

(21) Appl. No.: 15/762,005

(22) PCT Filed: Sep. 16, 2016

(86) PCT No.: PCT/EP2016/071923
§ 371 (c)(1),
(2) Date: Mar. 21, 2018

(87) PCT Pub. No.: WO2017/050642
PCT Pub. Date: Mar. 30, 2017

(65) Prior Publication Data

US 2018/0226733 A1 Aug. 9, 2018

(30) Foreign Application Priority Data

Sep. 22, 2015 (DE) ..... 20 2015 105 023 U

(51) Int. Cl.
*H01R 11/14* (2006.01)
*H01R 11/09* (2006.01)
*H01R 4/48* (2006.01)

(52) U.S. Cl.
CPC ..... *H01R 11/09* (2013.01); *H01R 4/48* (2013.01); *H01R 4/4818* (2013.01)

(58) Field of Classification Search
CPC ..... H01R 4/48; H01R 4/4818; H01R 11/09
USPC ..... 439/776, 441
See application file for complete search history.

(56) References Cited

U.S. PATENT DOCUMENTS 4,171,861 A * 10/1979 Hohorst ..... H01R 4/4845 439/49
6,464,545 B2 * 10/2002 Yano ..... H01R 9/26 439/441
6,796,855 B2 * 9/2004 Fricke ..... H01R 4/4818 439/835
6,962,507 B2 * 11/2005 Suess ..... H01R 9/2691 439/532

(Continued)

FOREIGN PATENT DOCUMENTS

DE 202004019109 U1 4/2006
DE 202009013335 U1 1/2011

(Continued)

*Primary Examiner* — Abdullah A Riyami
*Assistant Examiner* — Vladimir Imas
(74) *Attorney, Agent, or Firm* — Laubscher & Laubscher, P.C.

(57) ABSTRACT

A connection device for conductors has at least one double conductor connection for connecting two conductors. The conductor connections are formed as direct plug connections each having a metal clamping cage formed of a highly conductive material such as sheet metal. A clamping spring is mounted on each clamping cage. Each clamping cage serves as a spring support for a clamping spring and as a contact element for each conductor.

11 Claims, 3 Drawing Sheets

(56) References Cited

U.S. PATENT DOCUMENTS

| | | | | |
|---|---|---|---|---|
| 7,104,833 | B2 | 9/2006 | Oesterhaus | |
| 7,287,999 | B2 * | 10/2007 | Holterhoff | H01R 4/4836 439/441 |
| 7,344,422 | B2 * | 3/2008 | Helmreich | H01H 50/14 439/709 |
| 7,785,134 | B2 * | 8/2010 | Dhandapani | H01R 4/4818 439/441 |
| 8,251,738 | B2 * | 8/2012 | Heckert | H01R 4/4836 439/441 |
| 8,491,327 | B2 * | 7/2013 | Hartmann | H01R 31/085 439/441 |
| 8,771,027 | B2 * | 7/2014 | Zhang | H01R 4/48 439/835 |
| 8,858,269 | B2 * | 10/2014 | Brand | H01R 4/4827 439/733.1 |
| 9,033,749 | B2 * | 5/2015 | Seberger | H01R 4/48 439/851 |
| 9,160,085 | B2 * | 10/2015 | Jun | H01R 4/4827 |
| 9,478,874 | B2 * | 10/2016 | Stolze | H01R 4/4836 |
| 9,502,790 | B2 * | 11/2016 | Kollmann | H01R 4/4818 |
| 9,761,964 | B2 * | 9/2017 | Meyer | H01R 4/4836 |
| 9,774,107 | B2 * | 9/2017 | Kamo | H01R 9/2416 |
| 9,799,979 | B2 * | 10/2017 | Kamo | H01R 4/4827 |
| 10,027,041 | B2 * | 7/2018 | France | H01R 9/2416 |
| 2003/0171041 | A1 * | 9/2003 | Blaha | H01R 4/4809 439/787 |
| 2003/0194918 | A1 * | 10/2003 | Fricke | H01R 4/4818 439/835 |
| 2007/0093121 | A1 * | 4/2007 | Helmreich | H01H 50/14 439/495 |
| 2011/0312228 | A1 * | 12/2011 | Schrader | H01R 4/4827 439/733.1 |
| 2014/0065892 | A1 * | 3/2014 | Jun | H01R 4/4827 439/787 |

FOREIGN PATENT DOCUMENTS

| | | | |
|---|---|---|---|
| EP | 0472040 | A1 | 2/1992 |
| EP | 1020954 | A2 | 7/2000 |
| EP | 1353407 | A1 | 10/2003 |
| FR | 2769411 | A1 | 4/1999 |
| GB | 1447935 | | 9/1976 |

* cited by examiner

Fig. 1c
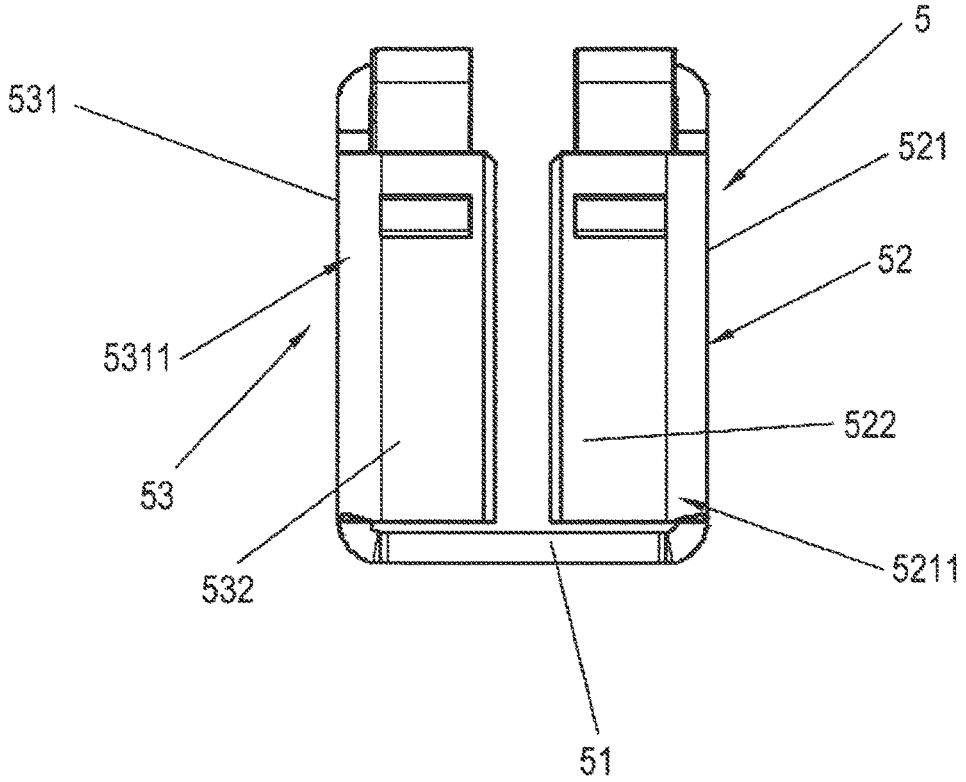
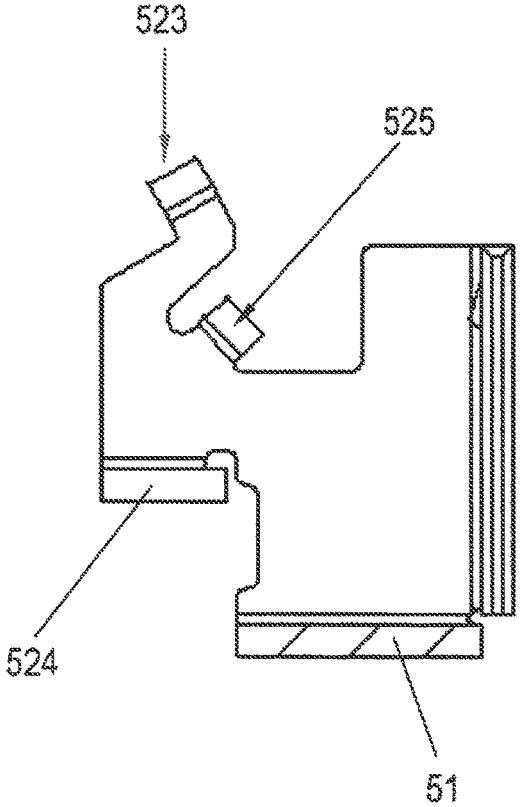
Fig. 1d

Fig. 1e
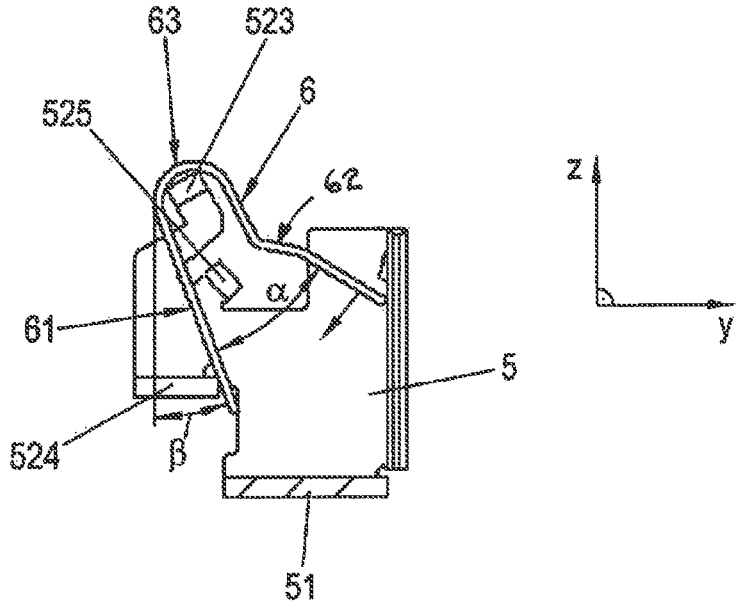
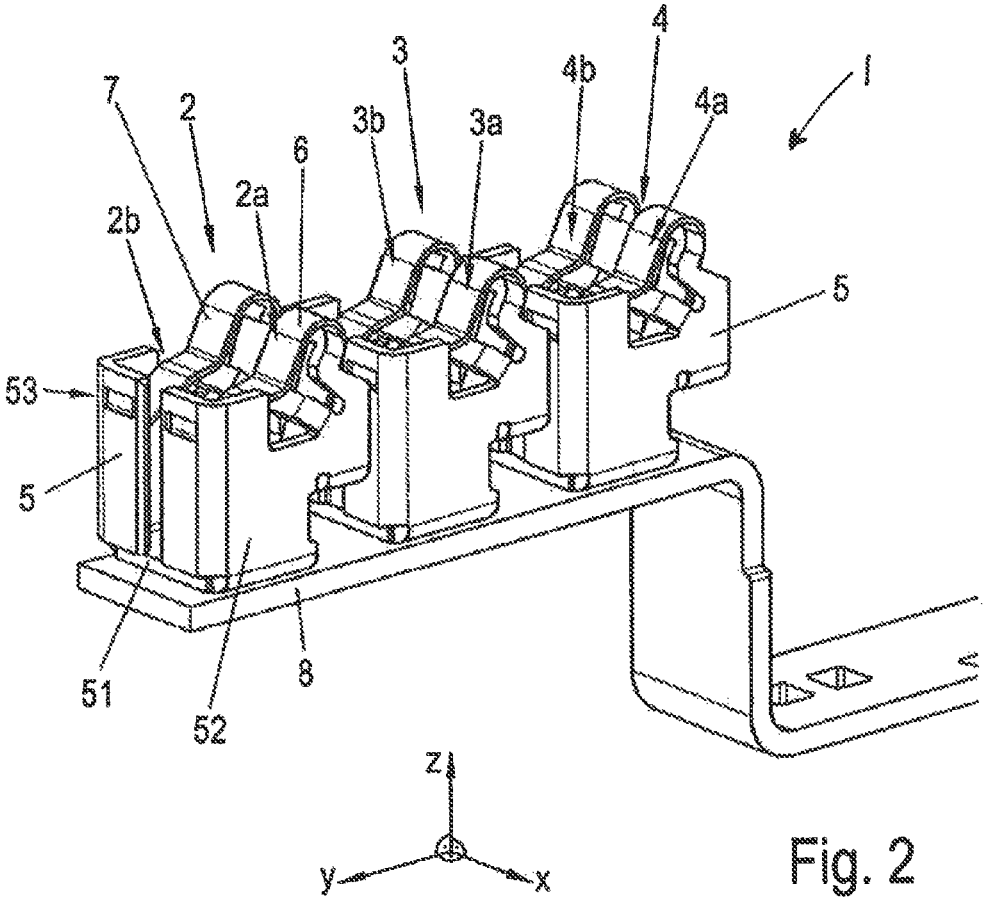
Fig. 2

CONNECTION APPARATUS FOR CONDUCTORS

CROSS-REFERENCE TO EARLIER APPLICATIONS

This application is a § 371 of PCT/EP2016/071923 filed Sep. 16, 2016. PCT/EP2016/071926 claims priority of DE 20 2015 105 023.2 filed Sep. 22, 2015. The entire contents of these applications are incorporated herein by reference.

BACKGROUND OF THE INVENTION

The invention relates to a connection apparatus for conductors. Arrangements of such apparatus are known in the art but suffer from disadvantages resulting from a generally complicated construction. It is against this background, that the invention was developed to provide a simply constructed connection apparatus of the generic type.

SUMMARY OF THE INVENTION

The invention relates to a terminal block or plug with a housing and at least one connection apparatus.

According to a preferred embodiment of the invention, the connection apparatus includes at least one double conductor connection which includes a pair of clamping cages, designed as spring carriers for two individual clamping springs, respectively, and as contact elements to contact one of the conductors with the respective assistance of one of the clamping springs.

Each clamping cage is easily and quickly manufactured as a single-piece element starting from a sheet metal strip using a punching or bending process. In so doing, the most wide-ranging functional areas are easily integrated in the clamping cage. The clamping cage is constructed in a compact manner and enables a simple assembly with the two clamping springs on a bus bar or a similar device and, in operation, provides simple switching on and off of the conductors.

BRIEF DESCRIPTION OF THE FIGURES

Other objects and advantages of the invention will become apparent from a study of the following description when viewed in the light of the accompanying drawing, in which:

FIGS. 1*b* and 1*c* are right side and front views, respectively, of the clamping cage of FIG. 1*a;*

FIG. 1*d* is a partial sectional left side a view of the clamping cage of FIG. 1*a* without clamping springs;

FIG. 1*e* is a partial cross-sectional view through the clamping cage of FIG. 1*a*; and FIG. 2 is a perspective view of a connection apparatus for conductors according to the invention.

DETAILED DESCRIPTION

FIG. 2 shows a connection apparatus 1 for conductors. This connection apparatus 1 is designed as a multiple conductor connector and by way of example enables the connection of six conductor ends (not shown).

The connection apparatus furthermore includes by way of example three double conductor connections 2, 3, 4, which each serve for the connection of two of the conductors. Each double conductor connection includes two direct plug connections, often referred to as push-in connections, 2*a*, 2*b*; 3*a*, 3*b*; 4*a*, 4*b* which each serve for contacting one of the two conductor ends or similar conductor devices.

Each of the double conductor connections 2, 3, 4 includes a metallic clamping cage 5. The cage is made of highly conductive material, preferably highly conductive sheet metal. The metallic clamping cage 5 of the double conductor connections 2, 3, 4 is designed with a dual purpose: (1) as spring carrier for two individual clamping springs 6, 7; and (2) as a contact element. Both of the clamping springs 6, 7 are preferably identical. Insofar as they are preferably designed individually, they are inexpensive to manufacture and are completely independent from one another regarding their function. The clamping springs 6, 7 are preferably manufactured from a spring sheet made of steel for example.

Figure 1A:
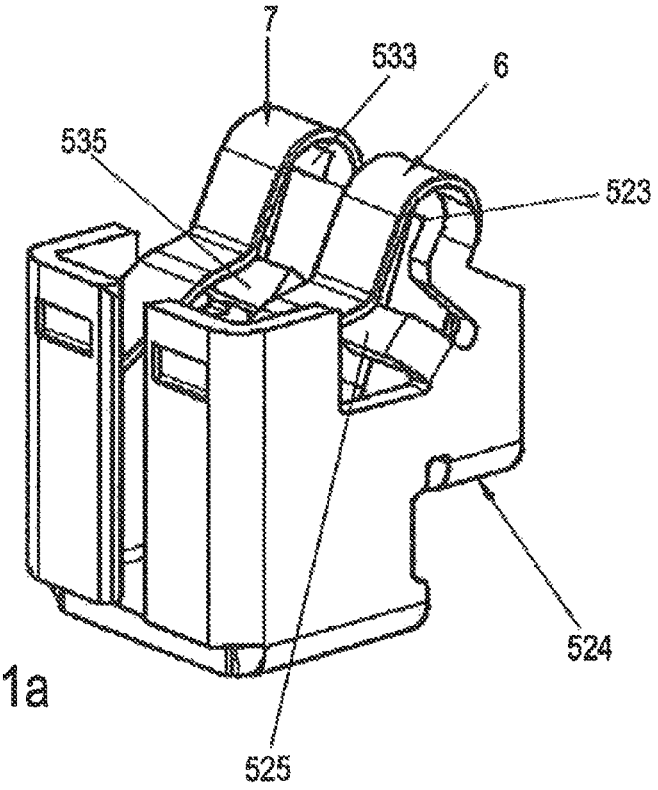
FIG. 1*a* is a perspective view of a clamping cage with two clamping springs.
Figure 1B:
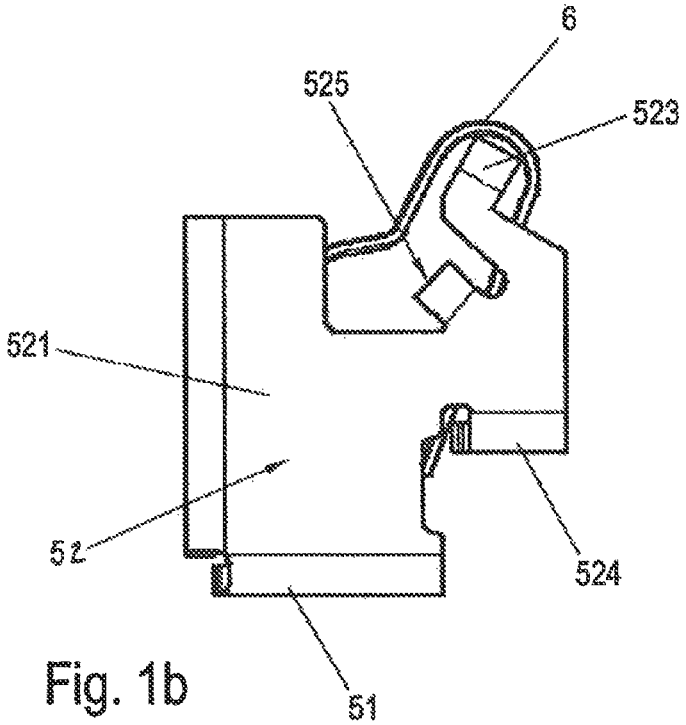

In a plan view, the clamping cage 5 shown in FIGS. 1*a-e* has a U-shape with a base wall 51 and two side wall assemblies 52, 53 which are designed to be perpendicular to the base wall 51. The base wall 51 is used to fasten the respective clamping cages 5 on a bus bar 8. Furthermore, the base wall 51 is preferably soldered or welded to the bus bar 8 as shown in FIG. 2. The clamping cages 5 of the double conductor connections 2, 3, 4 are arranged one after the other in a longitudinal direction Y of the bus bar 8. Inasmuch as the clamping cages 5 are not formed as a single piece with the bus bar 8, but rather are attached to the busbar, it is possible for the clamping cages 5 to be arranged very close to one another in the longitudinal direction Y of the bus bar 8. In particular, it is possible for the distance between the clamping cages in the Y-direction to be much smaller than the longitudinal length of the clamping cages 5 in this direction.

The side wall assemblies 52, 53 which extend perpendicular to the base wall 51 of the bus bar 8 serve on the one hand to hold the respective clamping springs 6, 7 and on the other hand to contact the two conductor ends that need to be contacted with the help of the clamping springs 6, 7. The conductor ends push against the side wall assemblies 51, 52 when they are inserted into the conductor connections. Beyond this, the side wall assemblies also serve as lateral conductor guides for the conductor ends that are to be contacted.

The side wall assemblies are designed as being symmetrically identical. They preferably do not touch one another; however, they are connected with one another by the base wall 51. They each include a side wall 521, 531 that is designed to be at a right angle to the base wall 51. In this manner, a U-shape is defined for each clamping cage. The side wall assemblies 52, 53 furthermore include contact sections 522, 532 for contacting the conductor ends which are positioned on one of the side edges 5211, 5311 of the side walls 521, 531 and extend from the same laterally in sections that are bent at 90°.

The side wall assemblies 52, 53 each include a spring carrying arm 523, 533 on the ends of the side walls 521, 531 facing away from the contact sections 522, 532. These spring carrying arms 523, 533 are bent inward toward each other at 90° from the side wall 521, 531.

The side wall assemblies 52, 53 further include a spring support arm 524 on the ends of the side walls 521, 531 that face away from the contact sections 522, 532, behind the spring carrying arms 523, 533 when observed in the Y-direction. These spring support arms 524 are in turn bent inward toward each other at 90° from the side wall 521, 531. The side wall assemblies 52, 53 on the ends of the side walls 521, 531 that face away from the contact sections 522, 532 in front of the spring carrying arms 523, 533 in the Y-direction include a spring deflection limitation arm 525, 535. These spring deflection limitation arms 525, 535 are in turn bent inward toward each other at 90° from the side wall 521, 531. The spring carrying arms 523, 533 and the spring deflection limitation arms 525, 535 are located underneath the spring carrying arms 523, 533 in the Z direction. The side walls 521, 531, the contact sections 522, 532 and the spring carrying, spring support and spring deflection limitation arms together define a U-shaped geometry in plan view.

The clamping spring 6 will now be described, it being understood that the other clamping spring 7 is identical to the clamping spring 6. The clamping spring 6 is substantially designed in a V shape and includes a supporting leg 61 and a clamping leg 62 that is arranged at an acute angle of between $10° < \alpha < 90°$ relative to the supporting leg. The supporting leg 61 and the clamping leg 62 are connected to one another by a spring return 63.

The spring returns 63 of the two clamping springs 6, 7 rests on the spring carrying arms 523, 533 or alternatively overlap the same. The clamping leg, which is also the contact leg, 62 is positioned towards the contact sections 522, 532, and preferably also touches the same in a manner that does not lead to contact with a conductor end and serves to push a conductor end against the contact sections 522 and 532. In this manner, two separate connectable and disconnectable clamping and contact locations are created for the conductor ends.

The spring deflection limitation arms 525, 535 are located underneath the clamping leg 62 and limit the deflection of the clamping spring leg. On the other hand, the spring support arms 524, 534 serve as a thrust bearing for the clamping spring supporting leg 61. The supporting leg 61, when mounted on each clamping cage, is preferably positioned obliquely at a spring angle of preferably $0° < \beta < 60°$ to the direction of insertion Z of the conductor.

During assembly, the two clamping springs 6, 7 are preferably initially placed on the clamping cages 5. Then, the clamping cage or cages 5 with the two clamping springs 6, 7 are placed on the busbar 8. Alternatively, the clamping cages 5 are first placed on the bus bar 8 and then the springs are positioned on the clamping cages. In this manner, the busbars 8 are simply pre-fitted with the double conductor connections 2, 3, 4 and can be employed as pre-mounted units, for example in a terminal block housing or a plug housing or another type of housing.

The number of double conductor connections in the terminal block can easily be varied. It is also possible to place a plurality of busbars 8 with conductor connections in the housing, in particular in the terminal block housing.

The invention claimed is:

1. A connection device for conductors, comprising at least one double conductor connection including a pair of conductor connections for the connection of two conductors, respectively, each conductor connection comprising a direct plug connection including a conductive clamping cage and at least one clamping spring, each clamping cage having a U-shape configuration including one base wall and two side wall assemblies, said base wall being perpendicular to said side wall assemblies, each side wall assembly having a first wall configured to support one of said clamping springs and a second wall serving as a contact element to contact one of the conductors with one of said clamping springs, said clamping cage base wall extending parallel to a busbar and being fastened to the busbar by one of soldering and welding.

2. A connection device as defined in claim 1, wherein said clamping springs of each conductor connection are identical.

3. A connection device as defined in claim 1, wherein said clamping cage side wall assemblies are configured to clasp a respective clamping spring on one side and to contact an end of a conductor on another side, said clamping cage side wall assemblies being further configured to guide a conductor end for contact a clamping spring.

4. A connection device as defined in claim 1, wherein said clamping cage side wall assemblies are symmetrically identical.

5. A connection device as defined in claim 1, wherein each clamping cage side wall assembly further includes a contact section.

6. A connection device as defined in claim 5, wherein each clamping cage side wall assembly further includes a spring carrying arm and a spring support arm on the ends positioned facing away from said contact sections.

7. A connection device as defined in claim 6, wherein each clamping cage side wall assembly further includes a spring deflection limitation arm.

8. A connection device as defined in claim 1, wherein each clamping cage is configured as a unitary element formed from a sheet of metal.

9. A connection device as defined in claim 7, wherein each clamping spring has a V-shaped configuration and includes one supporting leg and one clamping leg which is arranged at an acute angle of between $10° < \alpha < 90°$ to said supporting leg, said supporting leg and said clamping leg being connected by a spring return.

10. A connection device as defined in claim 9, wherein each spring return is arranged on top of a spring carrying arm, said clamping leg being positioned toward a contact section, said spring deflection limitation arm being located under said clamping leg to limit movement thereof in an opening direction, said spring support arm serving as a thrust bearing for said supporting leg.

11. One of a terminal block and housing including at least one connection apparatus as defined in claim 1.

* * * * *